United States Patent [19]

Magnuson

[11] Patent Number: 5,063,804

[45] Date of Patent: Nov. 12, 1991

[54] OFFSET PUNCH PRESS ASSEMBLY FOR STRUCTURAL BEAMS

[75] Inventor: James M. Magnuson, Kankakee, Ill.

[73] Assignee: Peddinghaus Corporation, Bradley, Ill.

[21] Appl. No.: 496,429

[22] Filed: Mar. 20, 1990

[51] Int. Cl.[5] ..... B26F 1/02; B26D 5/02

[52] U.S. Cl. ..... 83/368; 83/560; 83/527; 83/615

[58] Field of Search ..... 83/368, 420, 446, 449, 83/527, 560, 615, 623, DIG. 2

[56] References Cited

U.S. PATENT DOCUMENTS

| | | | |
|---|---|---|---|
| 3,720,125 | 3/1973 | Scott | 83/146 |
| 3,722,337 | 3/1973 | Brolund et al. | 83/137 |
| 3,785,235 | 1/1974 | Peddinghaus et al. | 83/615 |
| 3,805,659 | 4/1974 | Fisher, Jr. | 83/560 |
| 3,817,135 | 6/1974 | Valente | 83/560 |
| 3,897,707 | 8/1975 | Kruse et al. | 83/560 |
| 3,919,907 | 11/1975 | Kindgren | 83/560 |
| 4,040,320 | 8/1977 | Cloup | 83/560 |
| 4,061,064 | 12/1977 | Kindgren et al. | 83/368 |
| 4,631,996 | 12/1986 | Magnuson | 83/23 |

OTHER PUBLICATIONS

"Peddinghaus Peddimat Structural Fabrications Systems for Economical Structural Steel Fabrication" published by Peddinghaus Corporation, 300 N. Washington Ave., Bradley, IL 60915 U.S.A. and bearing on the last page, the desigation 683 GC5M, pp. 10 and 11.

Peddinghaus Industries drawings: XYZ, YA-3458274, A-3454974, A-3454955, YA-3457989, YA-3458479, YA-3458389, YA-19502-000-00-00 YA-3450637, and A-3460639.

*Primary Examiner*—David Jones

*Attorney, Agent, or Firm*—Dressler, Goldsmith, Shore, Sutker & Milnamow, Ltd.

[57] ABSTRACT

An assembly of punch presses is provided for punching holes in first and second opposed flanges joined by a web in a structural beam. The first and second punch presses are arranged in a first pair to punch the first flange from a first side of the beam. A second pair of first and second punch presses are arranged to punch the second flange from a second side of the beam. The first punch press of each pair is arranged in a configuration offset from the second punch press of the pair along both the adjacent beam flange width and length. The offset configuration of the second pair has an opposite hand relationship with the first pair to permit the punch presses of the first pair to be positioned in an overlapping relationship with the punch presses of the second pair.

10 Claims, 7 Drawing Sheets

OFFSET PUNCH PRESS ASSEMBLY FOR STRUCTURAL BEAMS

TECHNICAL FIELD

This invention relates to an assembly of punch presses which is particularly suitable for being controlled as part of a system for automatically feeding structural beams to the punch presses which punch holes in the flanges of the beams at selected locations. Such systems are typically employed by structural steel fabricators which receive structural beams from mills and which fabricate the finished beams by cutting the beams to the finished lengths and punching holes in the beams for receiving bolts as necessary to erect the beams in a structure.

BACKGROUND OF THE INVENTION AND TECHNICAL PROBLEMS POSED BY THE PRIOR ART

A commercially successful structural beam punch press system is marketed in the United States of America by Peddinghaus Corporation, 300 North Washington Avenue, Bradley, Ill. 60915 U.S.A. under the trade name "Beamline" as part of the structural steel fabrication line sold under the trade name "Fabriline." This prior art system is described on pages 10 and 11 of the catalog entitled "Peddinghaus PEDDIMAT Structural Fabrications Systems For Economical Structural Steel Fabrication" published by Peddinghaus Corporation and bearing, on the last page, the designation "683 GC5M." The punch presses of that system are illustrated in a greatly simplified manner in FIG. 1. For ease of illustration, some of the components and assemblies of the system have been omitted.

In conventional structural beam fabrication shops employing a system such as the Fabriline system discussed above, beams are typically automatically conveyed through an assembly of punch presses for punching holes in the beams. Beams that are processed in this manner have a central web and two parallel flanges—one flange at each end of the web. Such beams are typically designated as I-beams, wide flange beams, light beams, and American standard beams. When such beams are erected in structures, the ends of the beams and/or other portions of the beams are typically connected together with bolts. The bolts are received in holes provided in the webs and flanges of the beams.

One conventional method for providing the holes in a beam is to punch the holes with one or more conventional punch presses. "Web" punch presses are used to provide holes in the beam web, and "flange" punch presses are used to provide holes in the beam flanges. Such punch presses may have conventional designs well-known to those skilled in the art. Various designs are disclosed in U.S. Pat. Nos. 4,631,996, 3,722,337, and 3,720,125.

The above-referenced conventional "Fabriline" system for punching holes in the flanges of the beam is illustrated in FIG. 1 wherein a beam 20 is conveyed in a generally horizontal orientation and has a horizontal web 22, a front flange 24, and a rear flange 26.

Holes are provided in the front flange by a front flange press unit 30, and holes are provided in the rear flange by a rear flange press unit 32. These units are oppositely facing but laterally offset along the length of the beam and are generally identical. The front flange press unit 30 punches holes in the front flange from the front side of the beam 20, and the rear flange press unit 32 punches holes in the rear flange from the rear side of the beam 20. Each press unit 30 and 32 includes a pair of spaced-apart, vertically aligned punch presses, namely a hydraulic cylinder operated upper punch press 36 and a hydraulic cylinder operated lower punch press 38. The upper punch press 36 punches holes in the flange above the web 22, and a lower punch press 38 punches holes below the web 22.

Such conventional punch press systems are adapted to process a variety of different size beams. Accordingly, one or both of the units 30 and 32 is adapted to be moved toward or away from the other unit so as to accommodate narrower or wider beams, respectively. Further, the flange press units 30 and 32 are each adapted to be moved vertically so as to locate the punch presses 36 and 38 on the flanges at selected distances from the web 22.

Typically, the four punches are operated separately and not simultaneously. For example, the beam 20 may be initially positioned lengthwise for punching the rear flange 26 with the rear flange press unit 32. The rear flange press unit 32 is then moved vertically to position the upper punch press 36 on the rear flange 26 above the web 22. After the upper punch press 36 of the rear flange press unit 32 is operated to punch the hole, the unit 32 is moved vertically, if necessary, to locate the lower punch press 38 of the rear flange press unit 32 adjacent the rear flange 26 below the web 22. If the second hole to be punched is not vertically below the first hole that was punched above the web 22 in the rear flange 26, then the beam 20 is moved lengthwise as necessary, and the second hole is then punched in the rear flange 26 below the web 22.

Subsequently, the beam 20 is moved lengthwise to position the front flange for being punched by the front flange press unit 30. The front flange press unit 30 is moved vertically upwardly or downwardly as necessary for the punching of the front flange 24 by the upper and/or lower punch presses 36 and 38, and the beam at 20 is moved lengthwise as necessary for proper location relative to the upper punch press 36 and lower punch press 38.

It will be appreciated that each flange press unit 30 and 32 includes a relatively massive, unitary, inner frame 40, having a generally "C"-shape, which forms a large portion of the upper punch press 36 and which forms a large portion of the lower punch press 38. The punch presses 36 and 38 include various conventional subassemblies and components mounted to the unitary inner frame 40. The inner frame 40 itself is carried by a conventional intermediate frame 50 and includes conventional mechanisms, such as hydraulic operators 54, for moving the inner frame vertically. An outer frame 60, which includes mounting rails 62, is provided for supporting the intermediate frame 50 and for permitting the intermediate frame 50 to be moved inwardly or outwardly relative to the beam 20. Conventional mechanisms, such as connecting rods 64 and hydraulic operators (not illustrated), are employed for this purpose.

The inner frame 40 of the front flange press unit 30 and the inner frame 40 of the rear flange press unit 32 are each relatively massive. Specifically, the upper and lower portions of each frame 40 must have a sufficient mass projecting outwardly from, and around, the punch press die so as to have sufficient strength to rigidly support the die against the punching forces. This results in the upper and lower portions of the frame 40 extending outwardly a considerable distance across the width of the beam. Accordingly, as best illustrated in FIG. I, the front flange press unit 30 must be offset laterally, along the length of the beam 20, from the rear flange press unit 32 to avoid interference, at least when used to punch small (narrow) beams. If the conventional press units 30 and 32 were located on either side of the beam 20 in a direct, opposed relationship transverse to the length of the beam 20, then the units 30 and 32 could not be positioned close enough to accommodate many of the narrower structural beams. Accordingly, the front and rear flange punch press units 30 and 32 are conventionally spaced apart along the length of the beam by an amount sufficient to accommodate the dimensions of the press units along the length of the beam and by an amount sufficient to provide adequate clearance for installation, service, and maintenance.

With the conventional flange punch press configurations described above, the front flange press unit 30 and the rear flange press unit 32 are each separately movable on individual sets of tracks or rails 62 and are typically spaced apart about five feet (i.e., from the center line of one flange press unit to the center line of the other flange press unit). While such systems work well in the applications for which they were designed, it would be desirable to provide an improved system that could be operated more easily and more efficiently.

Further, it would be advantageous if such an improved system could employ an arrangement that would reduce the number of parts and components so as to provide a less costly design.

It would also be beneficial if such an improved system could be provided with a very compact arrangement that would reduce the floor space required for the system and its operation. This would permit the overall installed cost to be reduced on a shop floor space basis.

It would also be desirable to provide an improved punch press assembly for more efficiently punching holes at end connection regions in beams. With conventional systems, the rear flange punch press unit is spaced a number of feet away from the front flange punch press unit relative to the length of the beam. Thus, the end connection region of the beam (where the holes are needed for the bolted beam connection) can be located adjacent only one or the other of the punch press units. Since the upper and lower punches in a conventional unit are fixed vertically relative to each other in that unit, it is usually possible to punch only one hole at a time in the flange at the end region of the beam.

It would be desirable to provide an improved punch press arrangement wherein at least two holes could be punched simultaneously in the flanges at the end connection region of a beam.

With the conventional "Beamline" punch press system described above with reference to FIG. 1, a pair of probes 70 is provided for each of the four punch presses. (A pair of probes 70 is most clearly illustrated for the rear flange press unit 32 on the upper punch press 36.) One probe 70 of each pair is provided on the upstream side of a punch press, and the other probe of the pair is provided on the downstream of the punch press. The two probes of the pair are mounted for being vertically positioned together as a unit relative to the punch press and beam.

Each probe pair is mounted on a lead screw 72 which moves the pair of probes 70 up or down to engage the web of the structural beam. For each pair of probes 70, appropriate switches (not illustrated) are provided for being actuated when a hollow plunger 74 carried by each probe engages the beam web. For each hole that is punched in a flange by the adjacent punch press, the associated pair of probes 70 is moved vertically to engage the beam web and thus determine the web elevation. The punch press can then be positioned vertically as necessary relative to the web for punching the hole at the desired elevation in the flange.

Each punch press requires a pair of probes 70—one on each side of the punch press—so as to enable the system to punch holes close to the leading or trailing ends of the structural beam. That is, if a hole is to be punched by one of the presses very close to the leading end of the beam, then the probe mounted on the downstream side of the punch press would not be able to engage the beam web since the leading end of the beam would not project far enough downstream of the punch press to extend adjacent that downstream probe. In that case, the probe on the upstream side of the punch press would engage the beam web and actuate the switch.

Analogously, when a hole is punched close to the trailing end of the beam, the probe on the upstream side of the punch press would not be able to engage the web since the beam would not extend rearwardly far enough beyond the punch press to be adjacent the upstream probe. In that case, the probe on the downstream side of the punch press would engage the web and actuate the switch.

It would be desirable to provide an improved punch press system with an improved arrangement that would permit sensing of the web location with a reduced number of probes.

It would be desirable to also provide such an improved punch press system with an improved arrangement for controlling the positions of the punch presses in response to the sensing of the structural beam location. This would accommodate improved repetitive accuracy on hole patterns and would improve efficiency. Such improvements would have a salutary benefit of accommodating operation of the control system to minimize processing time by utilizing high operational speeds based on increased measuring accuracy.

SUMMARY OF THE INVENTION

An improved assembly of punch presses is provided for punching holes in first and second opposed flanges joined by a web in a structural beam. First and second punch presses are arranged in a first pair to punch the first flange from a first side of the beam. A second pair of first and second punch presses are arranged to punch the second flange from a second side of the beam.

According to the teachings of the present invention, a highly efficient and compact arrangement is provided wherein the first punch press of each pair is arranged in a configuration offset from the second punch press of the pair along both the adjacent beam flange width and length. The offset configuration of the second pair has an opposite hand relationship with the first pair to permit the punch presses of the first pair to be positioned in an overlapping relationship with the punch presses of the second pair.

This unique arrangement permits sharing of frame components among the four punch presses to provide an efficient design at less cost.

This unique arrangement also permits two holes to be punched simultaneously on the same transverse plane at the end of a small beam—one in the front flange and one in the rear flange.

The entire assembly of the four punch presses has a much smaller envelope compared to conventional designs. This means that less floor space must be devoted to the punch press assembly. With this unique arrangement, the assembly of the four punches has a relatively small dimension along the length of the beam compared with the prior art. This permits the four punch presses to be carried on a single set of rails for movement transversely of the beam length.

The fact that the unique assembly of the four punch presses can be carried on the same set of tracks or rails for movement transverse to the beam length provides a very important advantage. Specifically, with one set of tracks, there is much less chance of misalignment of the presses during installation and/or operation.

Installation of the novel assembly is much easier than with conventional designs which require a separate set of tracks for the rear flange punch press unit and a separate set of tracks for the front flange punch press unit. Installation of such prior art systems was difficult because the rear flange press unit had to be accurately located in relation to the front flange press unit so that the position of the punched holes would have the correct relationship.

In contrast, with the arrangement of the present invention, the presses can be mounted on a single track means or pair of tracks which can be accurately fabricated and positioned during manufacture and then shipped to the installation site. Thus, the installer of the present invention press assembly need not be concerned with aligning sets of tracks in parallel and need not be concerned with establishing specific offset distances between pairs of tracks.

The novel arrangement of the punch press assembly of the present invention also readily accommodates the use of an improved control system which includes an improved beam web sensing system and an improved punch press vertical positioning system. The assembly also accommodates the transverse positioning of the punch press units by employing a conventional photocell system for detecting the side of the beam.

Numerous other advantages and features of the present invention will become readily apparent from the following detailed description of the invention, from the claims, and from the accompanying drawings.

BRIEF DESCRIPTION OF THE DRAWINGS

In the accompanying drawings forming part of the specification, in which like numerals are employed to designate like parts throughout the same.

DESCRIPTION OF THE PREFERRED EMBODIMENT

While this invention is susceptible of embodiment in many different forms, the specification and the accompanying drawings disclose only one specific form as an example of the use of the invention. The invention is not intended to be limited to the embodiment so described, and the scope of the invention will be pointed out in the appended claims.

For ease of description, the apparatus of this invention is described in a normal (upright) operating position, and terms such as upper, lower, horizontal, etc., are used with reference to this position. It will be understood, however, that the apparatus of this invention may be manufactured, stored, transported, used, and sold in an orientation other than the position described.

The apparatus of this invention includes certain conventional components, including some actuators and control systems and mechanisms, the details of which, although not fully illustrated or described, will be apparent to those having skill in the art and an understanding of the necessary function of such components.

Some of the figures illustrating the preferred embodiment of the apparatus show structural details and mechanical elements that will be recognized by one skilled in the art. However, the detailed descriptions of such elements are not necessary to an understanding of the present invention, and accordingly, are not herein presented.

Figure 1:
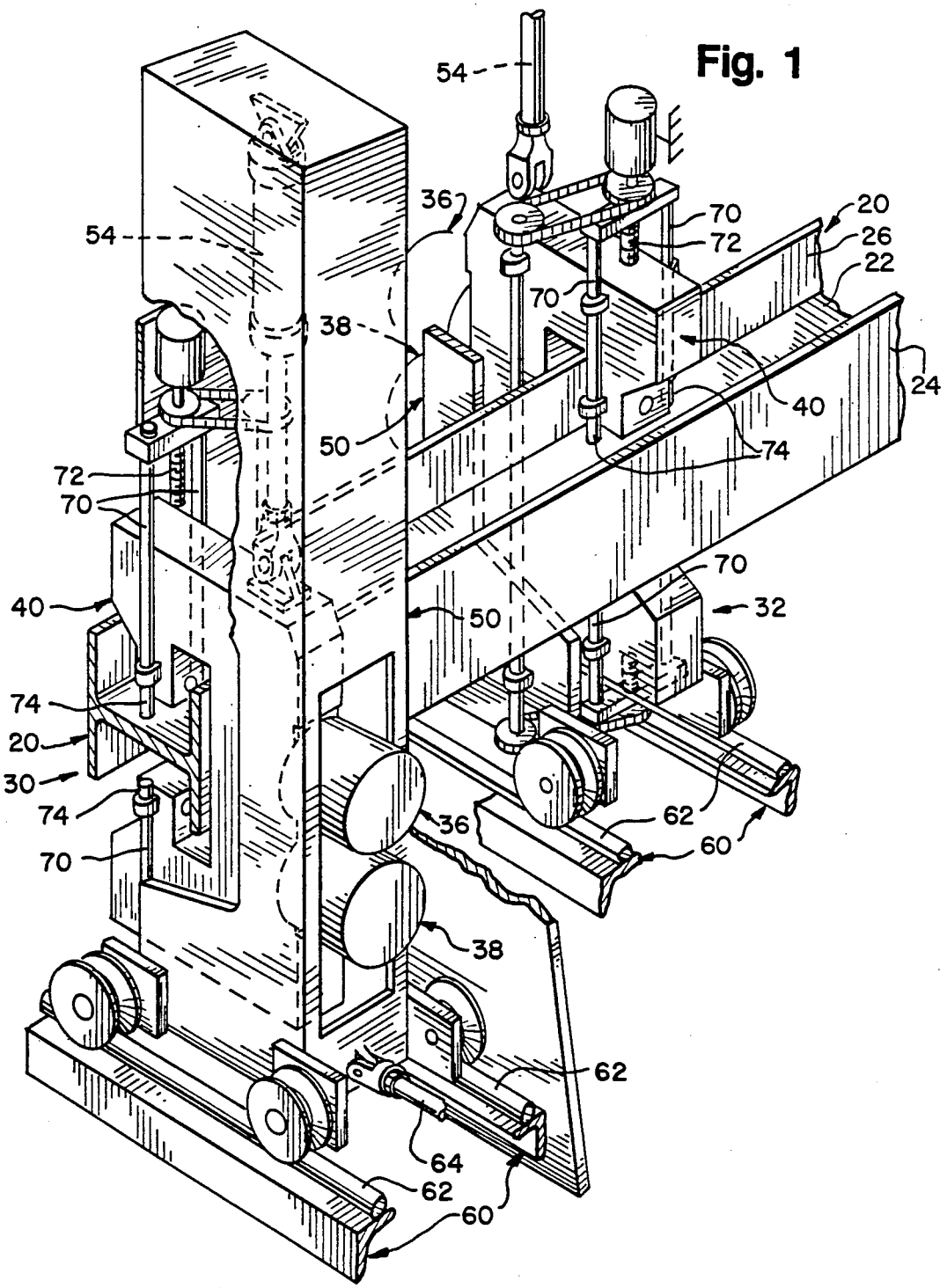
FIG. 1 is a greatly simplified, perspective view of portions of a conventional structural beam punch press system.
Figure 2:
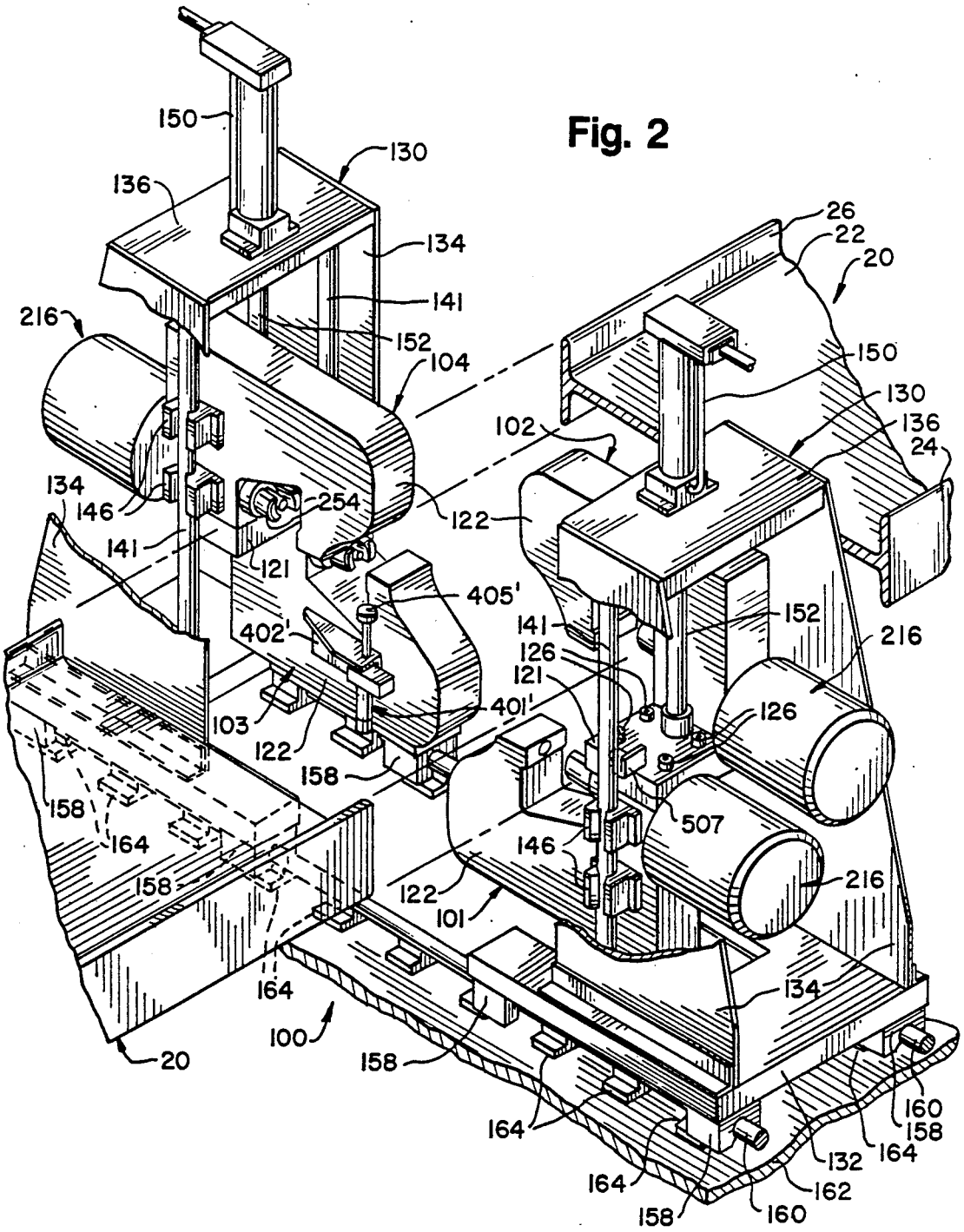
FIG. 2 is a greatly simplified, perspective view of the structural beam punch press system of the present invention shown with the punch presses positioned at a maximum spaced-apart orientation for accommodating the deepest structural beam for which the system is designed (i.e., a structural beam having the greatest perpendicular dimension between the beam flanges)

A greatly simplified illustration of the novel assembly of punch presses of the present invention is shown in FIG. 2 and is designated therein generally by reference numeral 100. The assembly 100 can be more easily installed and more efficiently operated than conventional systems. The assembly 100 has a reduced number of components so as to provide a less costly design and has a unique arrangement which is very compact so as to reduce the floor space required. The assembly 100 can be fabricated, shipped, and installed as one unit in contrast with conventional structural beam punch press systems which are provided in multiple unit arrangements.

The assembly 100 is illustrated in FIG. 2 at its "widest" orientation for receiving the largest structural beam 20 for which it is designed. In this context, the largest beam 20 is a beam having the greatest depth as defined by the extent of the beam web 22 between the front flange 24 and the rear flange 26.

The beam 20 would be moved lengthwise into position toward, through, and beyond the assembly 100 as may be necessary by suitable conventional beam conveying means, such as conveyors and work piece advancing mechanisms, which are well-known to those skilled in the art. For ease of illustration, such beam conveying means have not been shown in the Figures, and the details of such beam conveying means form no part of the present invention.

The assembly 100 includes four substantially identical punch presses 101, 102, 103, and 104. The punch presses are arranged in pairs with a first pair 101 and 102 located to punch the beam first or front flange 24 from a first or front side of the beam 20. The punch presses 103 and 104 are arranged in a second pair and are located to punch the second or rear flange 26 from the second or rear side of the beam 20.

The first punch press 101 of the first pair is arranged in a configuration offset from the second punch press 102 along the adjacent beam flange length and along the adjacent beam flange width (the beam width being the "height" of the flange 24 in the orientation shown in the Figures). Similarly, the first punch press 103 of the second pair is arranged in a configuration offset from the second punch press 104 along both the length and width of the adjacent beam flange 26.

Figure 3:
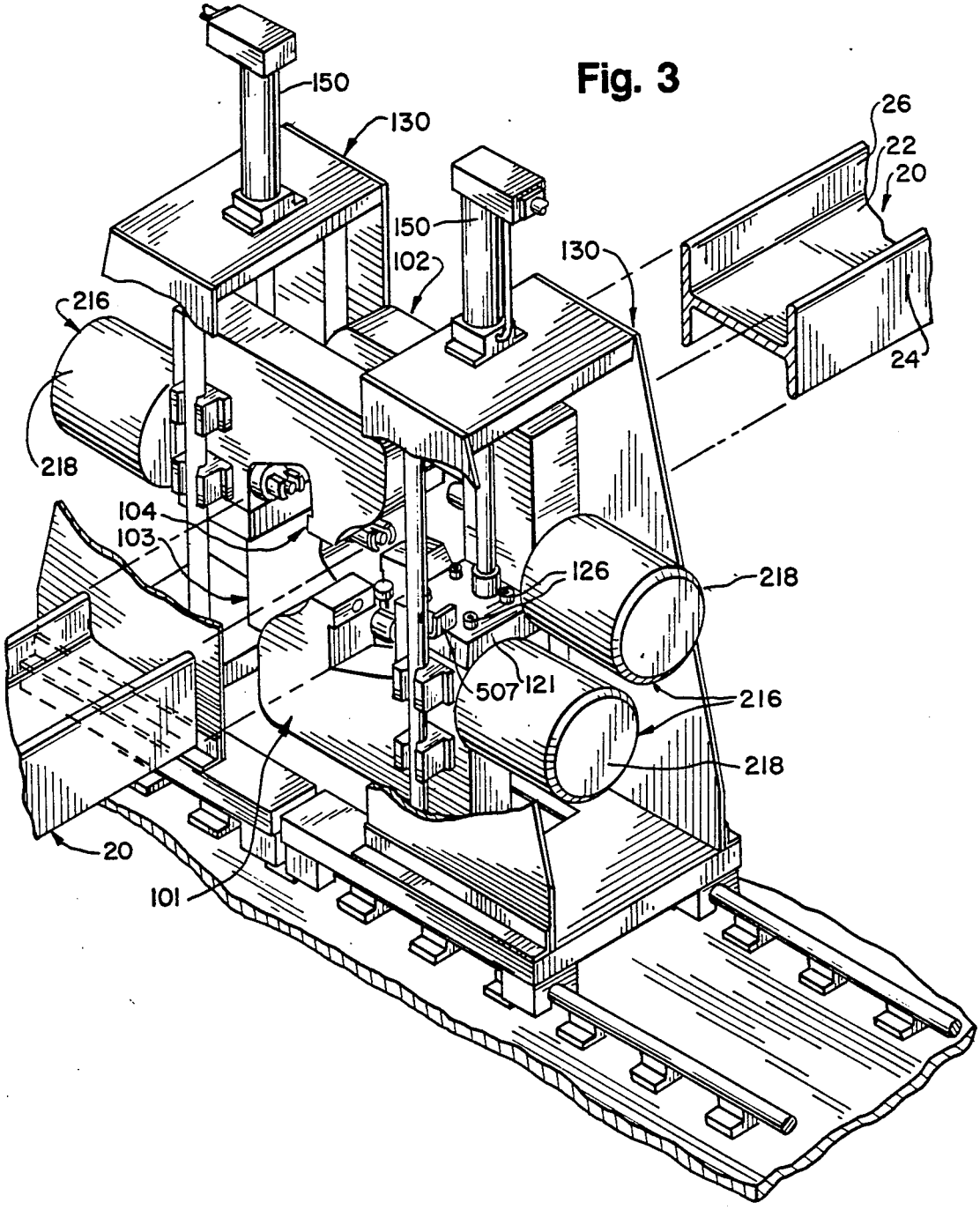
FIG. 3 is a view similar to FIG. 2 but showing the punch presses positioned in the closest orientation for accommodating small structural beams.

The offset configuration of the second pair of punch presses 103 and 104 has an opposite hand relationship with the first pair of punch presses 101 and 102 so as to permit the punch presses of the first pair to be positioned in an overlapping relationship with the punch presses of the second pair when the pairs of punch presses are moved toward each other as illustrated in FIG. 3.

It will be appreciated that the first punch press 103 of the second pair (i.e., the rear flange punch press pair) is located generally across from, but below, the second punch press 102 of the first pair (i.e., the front flange punch press pair). Similarly, the second punch press 104 of the second pair is located generally across from, but above, the first punch press 101 of the first pair. This provides a two-fold proper axis of symmetry perpendicular to the length of the beam 20. With this unique arrangement as illustrated in FIG. 3, the first punch press 101 of the first pair can overlap the second punch press 104 of the second pair transversely of the beam length, and the second punch press 102 of the first pair can overlap the first punch press 103 of the second pair transversely of the beam length.

The above-described unique arrangement which accommodates the overlapping punch press relationship permits the four punch presses to be fabricated and installed in a very compact assembly which takes up considerably less floor space than conventional punch press systems. This unique arrangement also permits a smaller, integral frame structure to be employed for supporting the components. Further, this arrangement accommodates movements of the components as necessary for the operation of the assembly to punch holes in the flanges of various size beams.

The assembly 100 includes a first support means for supporting the first pair of punch presses 101 and 102 together in a fixed relationship relative to each other. In the preferred embodiment illustrated, the first support means includes an associated intermediate first mounting plate 121 (FIGS. 2, 6, 7 and 8). The plate 121 is disposed between the first punch press 101 and the second punch press 102 so that the first punch press 101 is mounted with bolts 126 to the lower side of the plate 121 and so that the second punch press 102 is mounted with bolts 128 to the upper side of the plate 121.

Similarly, the other pair of punch presses 103 and 104 are mounted in an identical manner to an identical mounting plate 121. The first punch press 103 is mounted to the lower side of the plate 121, and the second punch press 104 is mounted to the upper side of the plate 121.

Figure 6:
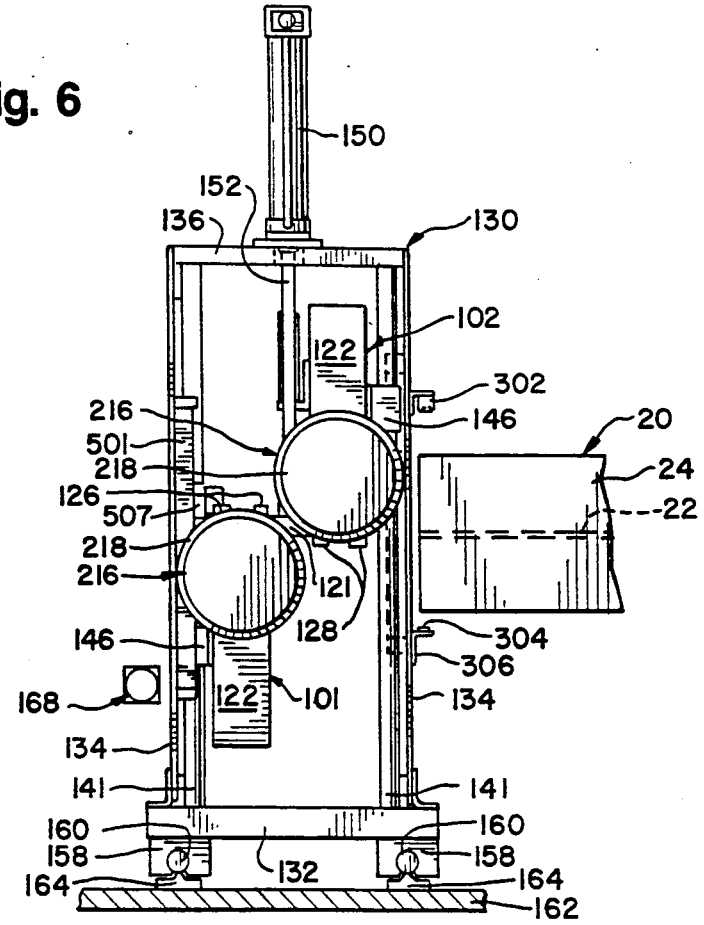
FIG. 6 is an elevation view of the right hand end of the system shown in FIG. 5.
Figure 7:
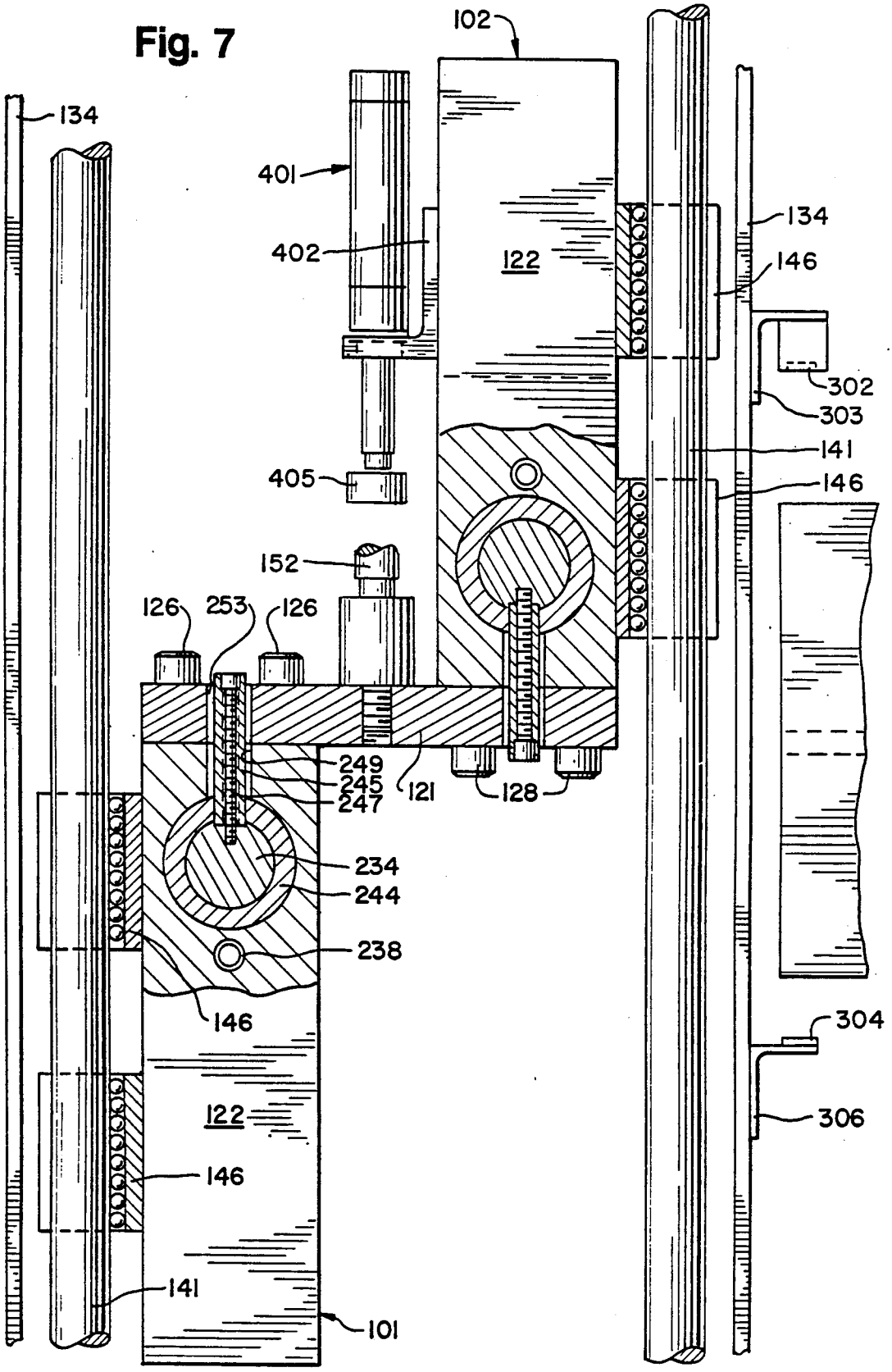
FIG. 7 is a greatly enlarged, fragmentary, partial cross-sectional view taken generally along the plane 7—7 in FIG. 5 with certain portions of the structure broken away to better illustrate interior detail.
Figure 8:
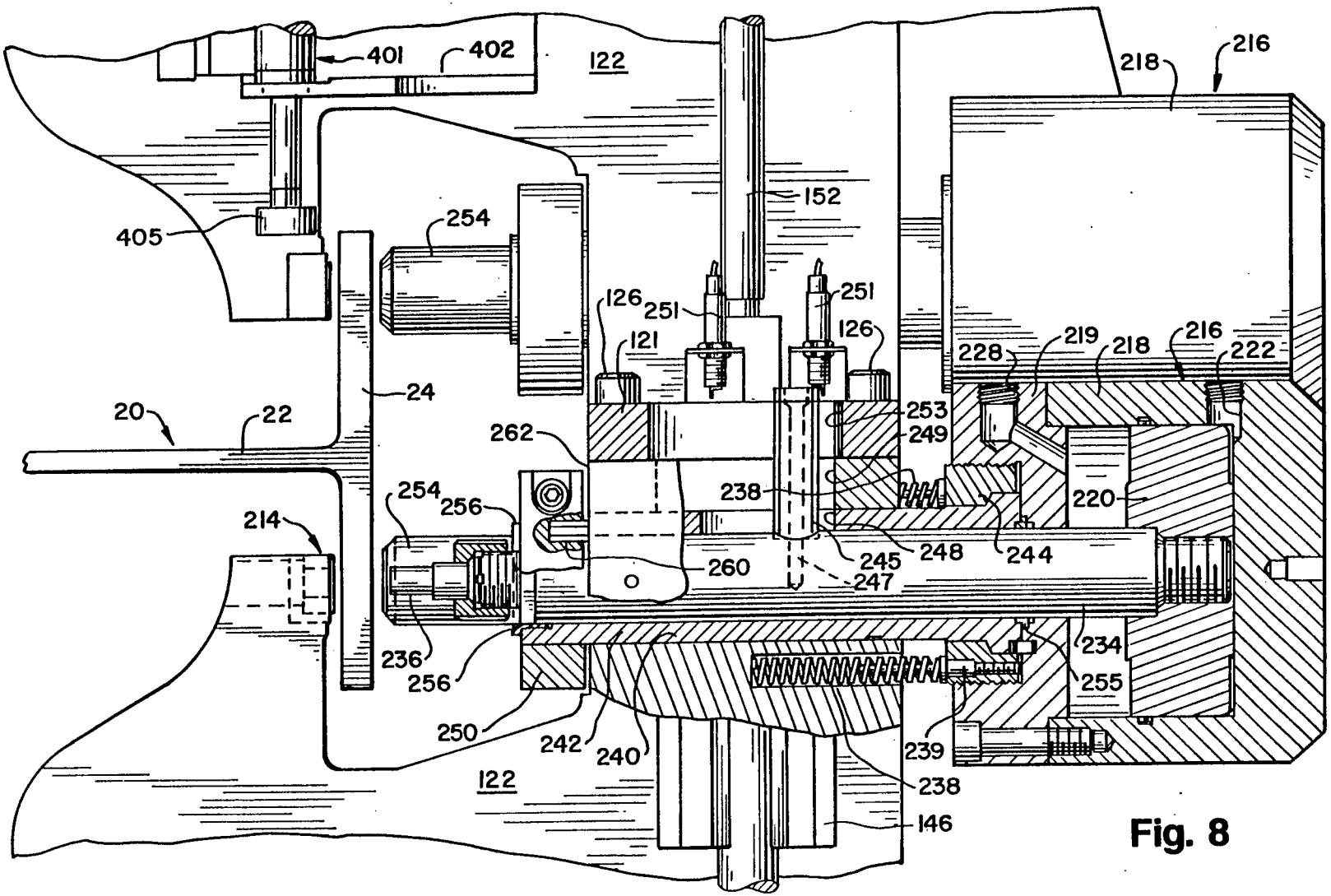
FIG. 8 is a greatly enlarged, fragmentary, partial cross-sectional view taken generally along the plane 8—8 in FIG. 5 with portions of the structure broken away to better illustrate interior detail.

Each punch press 101, 102, 103, and 104 has a generally C-shaped frame 122 which is mounted, as best illustrated in FIGS. 7 and 8, with bolts to the associated mounting plate 121. The two punch presses of each pair (i.e., pair 101, 102 and pair 103, 104) are thus vertically offset relative to each other. Further, as best illustrated in FIGS. 6 and 7, the C-shaped frames 122 are offset along the length of the mounting plate 121 (which necessarily establishes a longitudinal offset along the length of the beam 20).

In a contemplated commercial form of this invention, the vertical offset is about ten inches, and the longitudinal offset is about ten inches. This accommodates the components of each punch press without interference. Each C-shaped frame has an interior throat region to accommodate the flange of the beam 20. The web 22 of the beam 20 is moved between the C-shaped frames 122 of each pair of punch presses 101/102 and 103/104.

Figure 4:
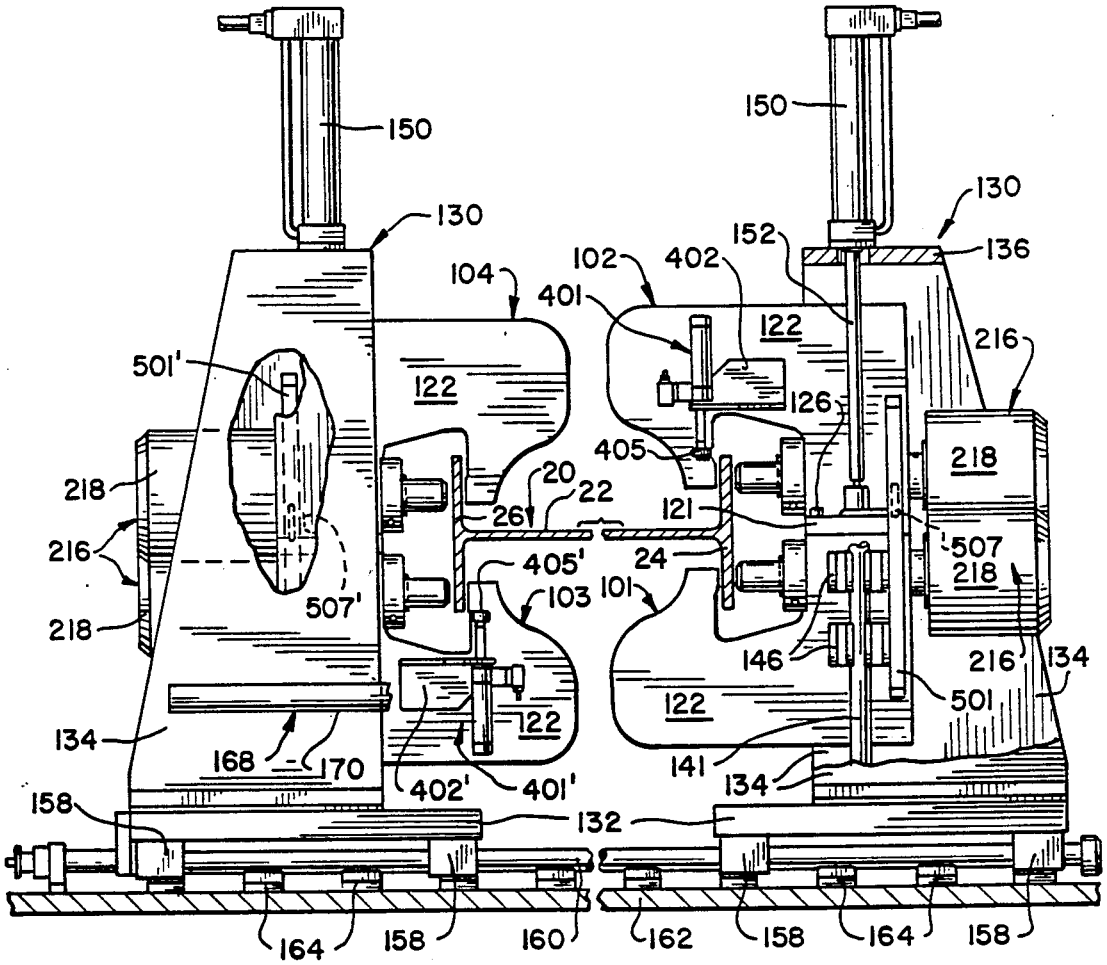
FIG. 4 is a fragmentary, partial cross-sectional side elevation view of the punch press system shown in FIG. 2, but with more structural detail being illustrated and with portions being broken away to better illustrate interior detail.

Associated with each pair of punch presses is a frame means 130 (FIG. 2) for carrying the first and second punch presses of each pair together With the associated mounting plate 121. Specifically, as best illustrated in FIGS. 2, 4 and 6, the frame means 130 includes a base 132, opposed side panels 134, top panel 136, and a pair of vertically oriented, side guide rods 141.

Each punch press C-shaped frame 122 is provided with guide blocks or linear bearings 146 which are slidably received on the adjacent guide rod 141. This arrangement permits each pair of punch presses and the associated mounting plate 121 to be vertically positioned upwardly or downwardly within the frame means 130. The vertical positioning of the punch presses within the frame means 130 is effected with a hydraulic actuator 150 which is mounted to the upper plate 136 of each frame means 130. The actuator 150 includes a downwardly extending connecting rod 152 which is connected to the mounting plate 121 between the punch presses as best illustrated in FIGS. 4, 6, 7, and 8.

The frame means 130 is adapted to be moved toward and away from the beam 20. To this end, the base 132 of each frame means 130 is provided with downwardly projecting bearings or guide members 158 (FIGS. 2, 4 and 6) for being slidably received on rails 160. The rails 160 are mounted to a base plate 162 by means of pedestals 164. In the embodiment illustrated, two rails 160 are provided as a spaced-apart pair of rails for mounting the assembly of the first (front flange) pair of punch presses 101 and 102 and for mounting the second (rear flange) pair of punch presses 103 and 104. The requirement of the prior art systems for an additional pair of rails is thus eliminated, and this greatly simplifies installation and alignment.

Figure 5:
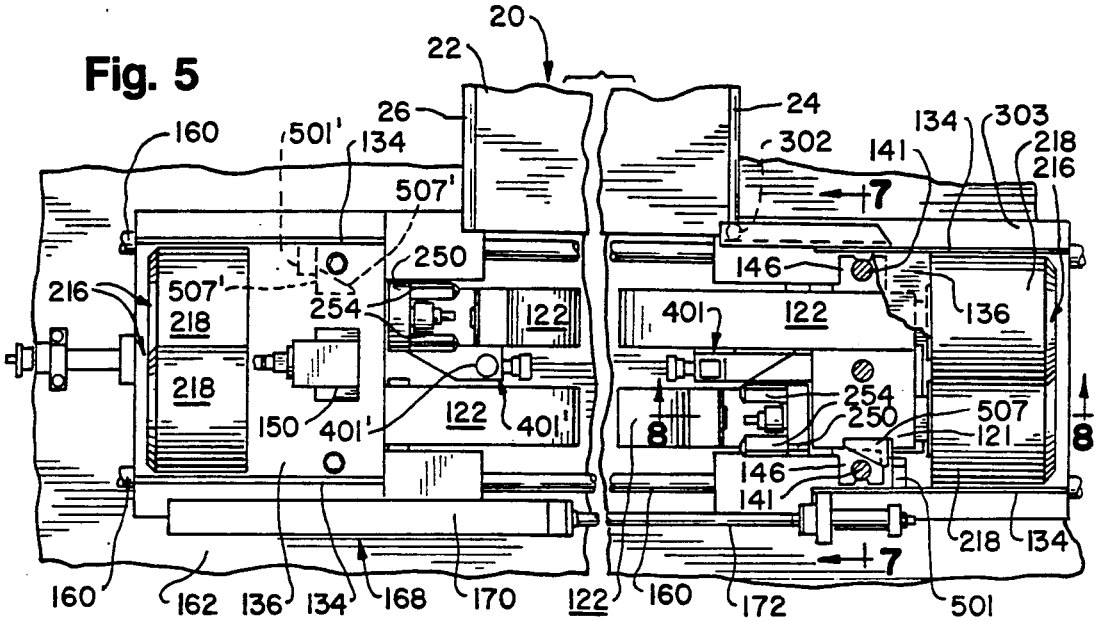
FIG. 5 is a top plan view of the system shown in FIG. 4.

The front flange pair of punch presses 101 and 102 and the rear flange pair of punch presses 103 and 104 can be moved on the rails 160 toward and away from the beam 20 by suitable conventional mechanisms, such as a hydraulic actuator 168 (FIGS. 5 and 6). The hydraulic actuator 168 includes a hydraulic cylinder 170 on one end which is connected to the frame 130 of the rear flange pair of punch presses 103 and 104 and includes a piston rod 172 connected at the other end to the frame means 130 of the front flange pair of punch presses 101 and 102. By locking one of the punch press frame means 130 to the rails 160 (by suitable conventional means not illustrated), the other pair of punch presses can be moved relative thereto by operation of the actuator 168. The details of such an actuating mechanism form no part of the present invention.

The punch presses 101, 102, 103, and 104 are substantially identical, and the punch mechanism per se may include any suitable conventional or special design. In the embodiment illustrated, each punch press punch mechanism is of a conventional design as generally disclosed in the U.S. Pat. No. 4,631,996 which is assigned to the assignee of the present invention.

Briefly, with reference to FIG. 8, the punch press frame 122 has a work piece supporting area generally designated by reference numeral 214 whereat the flange of the beam 20 is supported during the punching operation.

The punch press also includes a selectively operable, double-acting, fluid actuator generally indicated by the reference numeral 216. The actuator 216 is configured for operation by pressurized hydraulic fluid, and the actuator 216 includes a cylinder or housing 218 within which is a reciprocable piston 220. The actuator 216 also includes an end cap 219 bolted to the cylinder 218.

The hydraulic fluid is introduced into the cylinder 218 under pressure via a first port 222 defined in the distal end of the cylinder 218. Introduction of the pressurized hydraulic fluid through the inlet 222 acts to force the piston 220 toward the beam 20 for punching the beam.

A second hydraulic inlet 228 is provided for supplying pressurized hydraulic fluid into the cylinder on the other side of the piston 220 for forcing the piston 220 away from the beam 20 on the return stroke.

A piston rod or ram 234 is connected to the piston 220 and extends through a cavity in the frame 122. The end of the ram 234 extending beyond the frame 122 includes a punch tool 236.

The frame 122 defines a cavity 240 for receiving a cylindrical sleeve bushing 242 within which the ram 234 reciprocates. The sleeve bushing 242 is mechanically coupled via a locking ring 244 to the housing end cap 219. As discussed in more detail subsequently, the sleeve bushing 242 can move axially in the passage 240 independently of the piston rod or ram 234.

Affixed to the lower end of the sleeve bushing 242 by a locking ring 250 is a stripper which includes a pair of spaced-apart clamping portions or stripper members 254 (FIGS. 5 and 8) which are designed to engage and clamp the beam flange against the region 214.

A pair of bushings 255 and 256 are provided generally at respective opposite ends of the sleeve bushing 242 and provide bearing surfaces for the piston rod 234 to move axially with respect to the sleeve bushing 242.

The assembled cylinder 218 and end cap 219 of the actuator 216 are not fixedly mounted on the press frame 122, but rather are resiliently supported for limited horizontal movement with respect to the frame 122 by springs 238 (FIG. 8). A threadingly adjustable extension member 239 is disposed in one end of each spring 238 and engages an inner end portion of the actuator end cap 219.

A metal member 245 is mounted with a bolt 247 transversely to the piston rod 234. The member 245 projects outwardly through slots 248, 249, and 253 defined in the bushing 242, frame 122, and mounting plate 121, respectively. The member 245 moves with the piston rod 234 for being sensed by proximity switches 251 at the extreme ends of the piston movement range. The sensors 251 may be incorporated in a suitable conventional monitoring and/or control system, the details of which form no part of the present invention.

A shock absorber 260 is affixed to the locking ring 250. The shock absorber 260 comprises a rubber block or similar elastomeric element, and is intended to cushion movement of the locking ring 250 against a surface 262 of the frame 122 attendant to the stripping of the punch tool 236 from the beam flange.

It will be understood that the punch press mechanism and stripper includes the necessary seals, mechanical fastening means, and the like as will be known to those of skill in the art.

In operation, hydraulic pressure is provided to the press actuator 216 through port 222 to first drive the tool 236 into the beam flange for punching the hole. The hydraulic pressure is then reversed (admitted through inlet port 228 instead of inlet port 222) for effecting the return stroke of the actuator piston to extract the tool from the beam flange. A very substantial force is required for stripping the tool 236 from the beam flange. Thus, the increasing reversed hydraulic pressure acts to first move the resiliently mounted actuator cylinder 218 and end cap 219, and thus the bushing 242 and stripper members 254, toward the beam flange relative to the spatially fixed actuator piston 220. Thus, as the actuator cylinder 218, end cap 219, and bushing 242 move toward the beam, the stripper members 254 are carried into clamping contact with the beam flange.

When the stripper members 254 engage the beam flange, they firmly clamp the beam flange against the press frame region 214, and the relative movement of the stripper members 254 with respect to the frame 122 ceases. The increasing hydraulic pressure then drives the actuator piston 220 and punching tool 236 away from the beam flange to withdraw the tool 236, and the stripping is complete. With the tool 236 stripped from the beam flange, the actuator piston 220 is no longer spatially fixed, and the actuator housing 218, end cap 219, bushing 242, and stripper members 254 can therefore move together away from the beam flange to provide the desired running clearance. When the actuator piston 220 has completed its return stroke, the reverse fluid pressure can be relieved, the beam and/or punch press can be repositioned, and the tool 236 can again be driven toward the beam flange to repeat the cycle of operation.

Other features and advantages of the conventional punch press mechanism are described in the above-identified U.S. Pat. No. 4,631,996, and the description of the apparatus in that patent is incorporated herein by reference to the extent pertinent and to the extent not inconsistent herewith. It will be appreciated, however, that the detailed design and specific structure of the mechanisms for punching a hole in the beam flange may be of any suitable or special conventional design, and the detailed design and specific structure form no part of the present invention.

The novel punch press assembly of the present invention accommodates a convenient system for sensing the location of the beam web and accommodates the provision of an improved arrangement for controlling the positions of the punch presses in response to sensing the lengthwise position of the beam. In particular, the lateral or transverse position of the edge of the beam flange 24 can be determined by conveniently mounting a special or conventional photocell sensing system on the frame means 130 of the front flange pair of punch presses as best illustrated in FIG. 6. A photocell light source 302 is mounted via an angle 303 to the side member 134 for directing light to a photocell receiving sensor 304 which is mounted to an angle 306 on the side frame 134 below the light source 302.

In operation, the front flange pair of punch presses can be moved transversely toward the beam 20 by moving the frame means 130 on the rails 160 until the light beam is interrupted by the edge of the beam front flange 24. Actuation of a conventional switch by the sensor 304 in response to the interruption of the light beam may be employed in the control circuit of the system for stopping the movement of the frame 130 at that point, or after a further predetermined amount of movement.

In one form of operation, it is contemplated that the beam 20 would be initially aligned relative to the rear flange pair of punch presses 103 and 104 so as to be properly positioned transversely relative to the rear flange pair of punch presses for being received therein.

Each pair of punch presses is also initially vertically positioned to a preselected position based upon the nominal size of the beam being processed. This insures that the beam web and flanges can later be received in the region between the punch presses without interference after the proper transverse position of the front flange punch presses have been established as described in detail hereinafter.

The front flange pair of punch presses 101 and 102 is initially located at the maximum or widest spacing from the rear flange punch presses 103 and 104. During the transverse positioning of the punch presses relative to the beam 20, the leading end of the beam 20 is located adjacent the upstream side of the punch press assembly as illustrated in FIGS. 5 and 6 so as to interrupt the photocell light beam, but the beam 20 does not initially extend into the region between the punch presses. The punch presses 101 and 102 would then be moved toward the rear flange punch presses 103 and 104 until the desired position is established by the control system in response to the actuation of the photocell sensing system.

After completion of the transverse positioning of the punch presses, the beam 20 can be moved between the punch presses, and then the punch presses can be positioned vertically as necessary to punch the flange holes at the desired elevations. With the conventional "Beamline" brand punch press system previously described, the vertical location of the beam web relative to the punch presses is sensed by probes, and the system requires two web sensing probes for each of the four flange punch presses. In contrast, the novel punch press assembly of the present invention includes a unique web sensing system that requires only two web sensing probes rather than eight.

As illustrated in FIG. 4, a probe 401 for sensing the upper surface of the beam web 22 is mounted with an angle bracket 402 to the side of the second punch press 102 of the pair of front flange presses. As best illustrated in FIGS. 5 and 7, the probe 401 is centered between the two front flange punch presses 101 and 102.

The probe 401 includes a hollow plunger 405 and is adapted to be moved downwardly or upwardly by a suitable conventional hydraulic or pneumatic actuator well-known to those skilled in the art. The plunger 405 is adapted to engage the surface of the beam web 22 and thereby register the position of the surface of the beam web 22. An appropriate conventional sensing switch is associated with the probe 401 for being actuated upon engagement of the beam web 22 with the plunger 405. This establishes an initial set point elevation of the surface of the beam web 22. The probe, actuator, and switch may be of any suitable, conventional design known to those skilled in the art, and the detailed structures of such components form no part of the present invention.

An appropriate control system is provided for processing the signal from the probe switch to a conventional linear encoder 501 (FIG. 4) carried by the punch press assembly. The encoder 501 includes an assembly fixed to the side wall 134 of the frame 130 of the punch press pair and also includes a position indicating assembly 507 which is mounted to, and which is Vertically movable with, the punch press pair mounting plate 121.

The probe switch signal is processed to "zero out" the encoder control at that point. The encoder 501 can then register vertical movement of the punch presses from that "zero" set point corresponding to the initial sensed elevation of the beam web surface. Vertical positioning of the punch presses (by the actuator 150) can be closely controlled in this manner by the encoder 501. The probe 401 is retracted from the web before the punch presses 101 and 102 are moved vertically by the actuator 150. The linear encoder may be of a suitable type, the details of which form no part of the present invention.

The pair of beam rear flange punch presses 103 and 104 is provided with a web probe 401' which is substantially identical to the above-described web probe 401 except that the probe 401' is mounted to the lower punch press 103 for engaging the bottom surface of the beam web 22 as best illustrated in FIGS. 4 and 5. The probe 401' is mounted with an angle bracket 402' to the side of the rear flange lower punch press 103 so that it is located, as best illustrated in FIG. 5, longitudinally between the lower punch press 103 and upper punch press 104.

The probe 401' includes a plunger 405' and is movable vertically by suitable conventional means, such as a hydraulic or pneumatic cylinder actuator, to engage the lower surface of the beam web 22. The probe 401' actuates a switch in the control system of an encoder 501' similar to the encoder 501 associated with the front flange pair of punch presses described above. The encoder 501' for the rear flange pair of punch presses is mounted to the frame member 134 of the rear flange punch presses and operates with a movable assembly 507' on the punch press mounting plate 121 in a manner analogous to the encoder assembly 501 and 507 described above.

Typically, holes are punched in a structural beam in the end regions where the structural beam is to be connected to other beams. In operation, the novel punch press assembly can be operated to punch holes very close to the leading or trailing end of the beam 20. For example, if it desired to punch a hole in the beam front flange 24 above the web 22 with the front flange upper punch press 102, then the beam 20 is first conveyed so that the beam leading end extends sufficiently beyond the punch press 102 where the beam web can be engaged by the probe 401.

After the encoder 501 is initially set for the corresponding elevation of the top surface of the beam web 22 as determined by engagement with the probe 401, the probe 401 is retracted. Then the actuator 150 is operated to move the punch presses so that the upper punch press 102 is vertically positioned at the desired vertical elevation on the flange 24. This is accomplished with the encoder 501 monitoring the vertical movement relative to the initial zero set point elevation established when the probe plunger 405 engaged the top surface of the beam web 22. The beam 20 is then conveyed rearwardly (from left to right as viewed in FIG. 2) until the region to be punched at the leading end of the beam is located at the desired longitudinal position adjacent the upper punch press 102.

A similar procedure is employed for punching a hole with the lower punch press 101 in the flange 24 very close to the trailing end of the beam. In that situation, the beam 20 would be initially positioned so that the trailing end projects sufficiently upstream of the punch press 101 where the beam web 22 can be engaged by the probe 401. After establishing the web elevation, the vertical positioning of the punch press 101 and final longitudinal positioning of the beam 20 would be effected.

The operation of the probe 401' in conjunction with the rear flange punch presses 103 and 104 is analogous to the operation just described with respect to the probe 401 and front flange punch presses 101 and 102.

The novel punch press assembly of the present invention permits two holes to be punched simultaneously in relatively small beams, as well as in larger beams. For example, one hole can be punched in the front flange by the punch press 102 while another hole can be simultaneously punched in the rear flange by the punch press 103.

Since bolted connections in structural beams typically require holes in the front and rear flanges along the same transverse plane, the fact that the punch presses 102 and 103 are on the same transverse plane accommodates this simultaneous punching operation. Of course, since the front flange upper press 102 is vertically movable independently of the rear flange lower press 103, the precise vertical location of the holes can be independently established in the front and rear flanges by simultaneous operation of the control systems and actuators 150.

This provides an advantage over conventional beam punch press systems wherein the rear flange punch presses are typically spaced apart from the front flange punch presses by an amount that is so great that only one or the other of the pairs of punch presses can be located at one time in the end region of the beam where the holes are typically desired. Since the conventional two rear flange punch presses are fixed vertically relative to each other, and since the conventional front flange two punch presses are fixed vertically relative to each other, it is usually only possible to punch one hole at a time in the end region of a small beam flange.

It will be readily observed from the foregoing detailed description of the invention and from the illustrated embodiment thereof that numerous variations and modifications may be effected without departing from the true spirit and scope of the novel concepts and principles of this invention.

What is claimed is:

1. An assembly of punch presses for punching holes in first and second opposed flanges joined by a web in a structural beam, said assembly comprising:

four punch presses and main support means for supporting said presses adjacent a predetermined conveying path for said beam, said punch presses being arranged in paris with a first pair located laterally at a first side of said conveying path so as to punch the first flange from a first side of the beam and with a second pair located laterally at a second side of said conveying path so as to punch the second flange from a second side of the beam;

said first pair of punch presses including first and second punch presses arranged on, and supported by, said main support means in a configuration relatively offset from each other in (1) a direction transverse to said conveying path so as to accommodate the punching of the first flange on first and second sides of the web, and (2) a direction lengthwise along said conveying path;

said second pair of punch presses including first and second punch presses arranged on, and supported by, said main support means in a configuration relatively offset from each other in (1) a direction transverse to said conveying path so as to accommodate the punching of the second flange on the first and second sides of the web, respectively, and (2) a direction lengthwise along said conveying path; and said offset configuration of said second pair having an opposite hand relationship with said first pair so as to permit the punch presses of said first pair to be positioned in an overlapping relationship with the punch presses of said second pair.

2. The assembly in accordance with claim 1 in which said main support means includes first support means for supporting said first pair of punch presses together in a fixed relationship relative to each other; and second support means for supporting said second pair of punch presses together in a fixed relationship relative to each other.

3. The assembly in accordance with claim 2 in which said first support means includes an associated intermediate first mounting plate between said first and second punch presses of said first pair with said first punch press of said first pair mounted to one side of said first mounting plate and with said second punch press of said first pair mounted to the other side of said first mounting plate;

said first support means further includes a first frame means for carrying said first mounting plate and associated first and second punch presses of said first pair;

said second support means includes an associated intermediate second mounting plate between said first and second punch presses of said second pair with said first punch press of said second pair mounted to one side of said second mounting plate and with said second punch press of said second pair mounted to the other side of said second mounting plate; and said second support means further includes a second frame means for carrying said second mounting plate and associated first and second punch presses of said second pair.

4. The assembly in accordance with claim 3 further including a single pair of rails transverse to the length of said beam for defining a path along which each said frame means can be moved toward the other; and guide members on each said frame means for engaging said rails to guide each said frame means for movement along said rails.

5. The assembly in accordance with claim 3 further including guide means in each said frame means for guiding the assembly of one of said punch press pairs and associated mounting plate along a path of movement in a direction that is parallel to the beam flanges and normal to the length of the beam; and actuator means operatively connected between one of said frame means and the associated mounting plate for moving said punch press pair and associated mounting plate along said path.

6. The assembly in accordance with claim 5 further including probe means on carried on one of said punch presses and having a probe movable to engage the beam web; and control means responsive to said probe means location to operate said actuator means to move said plate to position said one punch press pair to a predetermined elevation relative to said web.

7. The assembly in accordance with claim 6 in which said control means includes (1) a position sensing means associated with said probe means for generating a signal upon termination of movement of said probe when engaged with said beam web, and (2) a linear encoder for securing the movement of said associated mounting plate and punch presses by said actuator means relative to said beam web as registered by said position sensing means.

8. The assembly in accordance with claim 3 further including bolts securing said punch presses to said mounting plates.

9. An assembly of punch presses having a reduced length for punching at least one hole in each of first and second opposed flanges joined by a web in a structural beam, said assembly comprising:

a first pair of first and second punch presses, a second pair of first and second punch presses, and main support means for supporting said pairs of presses adjacent a predetermined conveying path for said beam, said first pair being located laterally at a first side of said path so as to punch the first flange from a first side of the beam, said second pair being located laterally at a second side of said path so as to punch the second flange from a second side of the beam;

each said first punch press of each pair being arranged in a configuration offset from said second punch press of the pair in (1) a direction transverse to said conveying path and (2) a direction lengthwise along said conveying path; and said offset configuration of said second pair having an opposite hand relationship with said first pair to permit the punch presses of said first pair to be positioned in an overlapping relationship with the punch presses of said second pair.

10. An assembly of punch presses for punching at least one hole in first and second flanges joined by a web in a structural beam, said assembly comprising:

a first pair of first and second punch presses, a second pair of first and second punch presses, and main support means for supporting said pairs of pressed adjacent a predetermined conveying path for said beam, said first pair being located laterally at a first side of said path so as to punch the first flange from a first side of the beam, said second pair being located laterally at a second side of said path so as to punch the second flange from a second side of the beam;

said first and second punch presses of said first pair being offset relative to each other in (1) a direction transverse to said conveying path and (2) a direction lengthwise along said conveying path whereby said first punch press of the first pair can punch said first flange on a first side of said web and said second punch press of said first pair can punch said first flange on the second side of said web; and said first and second punch presses of the second pair being offset relative to each other in (1) a direction transverse to said conveying path and (2) a direction lengthwise along said conveying path whereby said first punch press of the second pair can punch said second flange on a first side of said web generally across from, but below, said second punch press of said first pair and whereby said second punch press of said second pair can punch said second flange on the second side of said web generally across rom, but above, said first punch press of said first pair, said assembly of punch presses having a two-fold proper axis of symmetry perpendicular to the length of said conveying path whereby said first punch press of said first pair can overlap said second punch press of said second pair transversely of said path length and whereby said second punch press of said first pair can overlap said first punch press of said second pair transversely of said path length.

* * * * *